US007644875B2

(12) United States Patent
Mochizuki et al.

(10) Patent No.: US 7,644,875 B2
(45) Date of Patent: Jan. 12, 2010

(54) INJECTOR

(75) Inventors: Kouichi Mochizuki, Anjo (JP); Masatoshi Kuroyanagi, Kariya (JP)

(73) Assignee: Denso Corporation, Kariya (JP)

( * ) Notice: Subject to any disclaimer, the term of this patent is extended or adjusted under 35 U.S.C. 154(b) by 15 days.

(21) Appl. No.: 12/068,898

(22) Filed: Feb. 13, 2008

(65) Prior Publication Data

US 2008/0217440 A1 Sep. 11, 2008

(30) Foreign Application Priority Data

Mar. 5, 2007 (JP) ..... 2007-054022

(51) Int. Cl.
*B05B 1/08* (2006.01)
*F02M 61/20* (2006.01)

(52) U.S. Cl. ..... 239/102.2; 239/88; 239/533.9; 239/584; 251/129.06; 123/470

(58) Field of Classification Search ..... 239/88, 239/91, 96, 102.1, 102.2, 533.9, 533.12, 239/584; 123/498; 251/129.06
See application file for complete search history.

(56) References Cited

U.S. PATENT DOCUMENTS 4,635,849 A * 1/1987 Igashira et al. ..... 239/102.2
6,499,471 B2 * 12/2002 Shen et al. ..... 123/498
6,676,035 B2 * 1/2004 Lorraine et al. ..... 239/102.2
6,766,965 B2 * 7/2004 D'Arrigo ..... 239/102.2
7,100,895 B2 9/2006 Schürz et al.
2008/0217429 A1 * 9/2008 Mochizuki et al. ..... 239/91

FOREIGN PATENT DOCUMENTS

WO 2005/075811 8/2005

* cited by examiner

*Primary Examiner*—Steven J Ganey
(74) *Attorney, Agent, or Firm*—Nixon & Vanderhye, PC

(57) ABSTRACT

An injector has an inner sleeve between a needle pressure receiving face of a needle and a rear end face of a valve body. The inner sleeve is slidably fitted to an outer periphery of a middle shaft section of the needle. The inner sleeve receives a reaction force of a spring located between the inner sleeve and a pressurizing piston, so an axial tip end (edge section) of the inner sleeve is pressed against the rear end face to achieve close contact therebetween. Thus, a volume of a pressure chamber can be reduced, so a valve opening force for lifting the needle can be acquired efficiently. Accordingly, injection of a large flow rate can be performed by increasing a lift amount of the needle and also quick lifting of the needle can be performed.

7 Claims, 3 Drawing Sheets

INJECTOR

CROSS REFERENCE TO RELATED APPLICATION

This application is based on and incorporates herein by reference Japanese Patent Application No. 2007-54022 filed on Mar. 5, 2007.

BACKGROUND OF THE INVENTION

1. Field of the Invention

The present invention relates to an injector that performs injection supply of high pressure fuel to a combustion chamber of an internal combustion engine.

2. Description of Related Art

An injector using an electromagnetic valve as an actuator is commonly used. In order to realize a large flow rate and high response, an injector using a piezoelectric actuator with a large generative force and high response is proposed. For example, an injector described in Patent document 1 (International Publication No. 2005/075811) has a piezoelectric actuator 100 that makes a displacement when voltage is applied thereto, a pressurizing piston 110 driven by the piezoelectric actuator 100, an outer sleeve 120 for slidably holding an outer periphery of the pressurizing piston 110, a pressure chamber 130, internal pressure (hydraulic pressure) of which increases/decreases according to movement of the pressurizing piston 110, a needle 160 that is slidably held inside a valve body 140 and that has a function to open/close an injection hole 150 and the like as shown in FIG. 6.

The pressure chamber 130 is fluid-tightly defined by the pressurizing piston 110, the outer sleeve 120, the needle 160 and the valve body 140. If the voltage is applied to the piezoelectric actuator 100 and the pressurizing piston 110 is depressed downward in the drawing, the volume of the pressure chamber 130 decreases and the internal pressure rises.

The internal pressure of the pressure chamber 130 acts on a pressure receiving face 161 formed on the needle 160 to function as a valve opening force for biasing the needle 160 in a valve opening direction (upward direction in the drawing). If the valve opening force exceeds a valve closing force (reaction force of the spring 170 and the like) biasing the needle 160 in a valve closing direction, the needle 160 lifts and opens the injection hole 150. Thus, the high pressure fuel supplied to an inside of the valve body 140 is injected into a combustion chamber 180 of the engine from the injection hole 150.

In order to efficiently generate the hydraulic pressure (the internal pressure of the pressure chamber 130) for driving the needle 160, fuel leak from the pressure chamber 130 should be inhibited and the volume of the pressure chamber 130 should be made small.

In the injector described in Patent document 1, the pressure chamber 130 includes a space A (a shade area in FIG. 6) formed between the pressure receiving face 161 of the needle 160 and an end face of the valve body 140. Therefore, it is difficult to make the pressure chamber 130 compact. In order to inhibit the fuel leak, strict management of a clearance at a needle sliding section S shown in FIG. 6 and precise processing are required. Accordingly, a cost can be increased.

SUMMARY OF THE INVENTION

It is an object of the present invention to provide an injector that has a pressure chamber with a reduced volume and that is capable of inhibiting fuel leak from the pressure chamber without requiring precise processing.

According to an aspect of the present invention, an injector has a piezoelectric actuator, a pressurizing piston, a pressure chamber, a valve body, a needle, an inner sleeve, and a spring. The piezoelectric actuator causes displacement when voltage is applied thereto. The pressurizing piston is driven by the piezoelectric actuator to move in an axial direction. The pressure chamber stores a pressurization fluid inside. Pressure of the pressurization fluid changes according to the movement of the pressurizing piston. The valve body is formed with a guide hole in the axial direction and with an injection hole at a tip end portion of the guide hole. An axial rear end face of the valve body on a side opposite from the injection hole side defines a wall face defining the pressure chamber. The needle is slidably held in the guide hole and opens/closes the injection hole. The needle has a middle shaft section protruding from the rear end face in a direction opposite from the injection hole side and a needle pressure receiving face, which has an external diameter larger than that of the middle shaft section and receives internal pressure of the pressure chamber in the axial direction such that the internal pressure of the pressure chamber acting on the needle pressure receiving face functions as a valve opening force for biasing the needle in a valve opening direction. The inner sleeve is located inside the pressure chamber and formed in the shape of a cylindrical body slidably fitted with an outer periphery of the middle shaft section. The spring biases the inner sleeve toward the rear end face.

The inner sleeve has an inner periphery sliding face of the cylindrical body for inhibiting the pressurization fluid in the pressure chamber from flowing out toward the injection hole side through a sliding gap between an outer peripheral face of the middle shaft section and the inner sleeve and an axial end portion for inhibiting the pressurization fluid in the pressure chamber from flowing out toward the injection hole side through a portion of the inner sleeve closely pressed against the rear end face by the spring.

With such the structure, the volume of the pressure chamber can be made small by locating the inner sleeve inside the pressure chamber. As a result, the valve opening force (the internal pressure of the pressure chamber acting on the needle pressure receiving face) necessary for lifting the needle can be acquired efficiently. That is, the internal pressure of the pressure chamber of the present invention is greater than that of a conventional injector having no inner sleeve even if the movement amount of the pressurizing piston driven by the piezoelectric actuator is equal to that of the conventional injector. Therefore, the valve opening force applied to the needle can be increased correspondingly. As a result, by increasing the lift amount of the needle, injection of a larger flow rate can be performed, and also, quick lifting of the needle can be performed. Thus, an injector achieving high response and high performance can be provided.

If the size of the valve opening force necessary for lifting the needle is the same as that of the conventional injector, the present invention can exert an effect of reducing a driving energy of the piezoelectric actuator.

Moreover, since the inner sleeve is slidably fitted to the outer periphery of the middle shaft section of the needle, the sliding sections of the inner sleeve and the middle shaft section can inhibit the fuel leak of the pressure chamber. The axial end portion of the inner sleeve is closely pressed against the rear end face of the valve body but the inner sleeve is not fixed to the valve body. Accordingly, the inner sleeve can move in the radial direction with respect to the valve body. Therefore, precise processing is required only in the internal diameter of the cylindrical body to be fitted with the middle shaft section. It is not necessary to secure coaxiality with the guide hole formed in the valve body. The guide hole of the valve body holding the needle is not required to inhibit the fuel leak between the guide hole and the needle. Therefore, the management of the clearance between the guide hole and the needle can be made easier correspondingly. As a result, productivity can be improved.

According to another aspect of the present invention, in the above injector, the inner sleeve has an edge section in an entire circumference of the axial end portion thereof and the edge section is pressed against the rear end face.

In this case, the area of the edge section contacting the rear end face of the valve body is small and contact pressure is high. As a result, sealing performance improves and the fuel leak from the pressure chamber can be inhibited.

According to another aspect of the present invention, in the above injector, the edge section of the inner sleeve is formed at an outermost periphery of the axial end portion of the inner sleeve.

In this case, the internal pressure of the pressure chamber is not applied to the axial end face of the inner sleeve radially inside the edge section. Since the internal pressure of the pressure chamber does not function as the force pushing up the inner sleeve, suitable sealing performance can be secured.

According to another aspect of the present invention, in the above injector, the inner sleeve has a spring receiving section formed in a flange shape by enlarging an outer peripheral portion of the cylindrical body radially outward, and one end of the spring is engaged with the pressurizing piston and the other end of the spring is engaged with the spring receiving section.

In this case, the biasing force of the spring acting on the inner sleeve increases when the internal pressure of the pressure chamber is increased by the movement of the pressurizing piston since the one end of the spring is engaged with the pressurizing piston. As a result, the edge section of the inner sleeve is pressed against the rear end face of the valve body more strongly. Therefore, the sealing performance improves and the fuel leakage from the pressure chamber can be inhibited.

According to another aspect of the present invention, in the above injector, the inner sleeve has a sleeve pressure receiving face, to which the internal pressure of the pressure chamber acts in a direction for biasing the inner sleeve toward the valve body side. The sleeve pressure receiving face has a larger area than that of the needle pressure receiving face.

The inner sleeve is slidably fitted to the outer periphery of the middle shaft section of the needle. Therefore, when the internal pressure of the pressure chamber rises and the needle lifts, there is a possibility that the inner sleeve lifts together with the needle due to a frictional force caused between the inner sleeve and the needle.

As contrasted thereto, according to the present invention, the area of the sleeve pressure receiving face is larger than that of the needle pressure receiving face. Accordingly, the force of the internal pressure of the pressure chamber acting on the sleeve pressure receiving face for depressing the inner sleeve is greater than the force of the internal pressure of the pressure chamber acting on the needle pressure receiving face for pushing up the needle. Therefore, the inner sleeve can be prevented from lifting together with the needle.

According to another aspect of the present invention, in the above injector, the valve body includes a body main member formed with the guide hole and a spacing member that is located on a side of the body main member opposite from the injection hole side and that is formed with a loose insertion hole in a radial center thereof for loosely inserting the needle therein. The body main member has an enlarged chamber having an internal diameter larger than that of the loose insertion hole on a side opposite from the injection hole side. An end face of the spacing member defining a side of the enlarged chamber opposite from the injection hole side and radially inside an inner periphery of the enlarged chamber functions as a stopper face for limiting a lift amount of the needle. The needle has a flange section projecting radially outward from an outer periphery of a portion of the needle passing through the inner periphery of the enlarged chamber. The flange section has an external diameter larger than the internal diameter of the loose insertion hole. The lift amount of the needle is limited because the flange section contacts the stopper face when the needle lifts by a predetermined amount in the valve opening direction.

The loose insertion means a state where the needle is inserted in the loose insertion hole formed in the spacing member with a gap, i.e., a state where a spatial margin exists between the inner periphery of the loose insertion hole and the outer periphery of the needle.

With such the structure, a stable injection quantity can be obtained irrespective of a displacement variation of the piezoelectric actuator.

According to yet another aspect of the present invention, the above injector further has a valve housing that defines a sealed space filled with the high pressure fluid between the valve body and the valve housing and that accommodates at least the piezoelectric actuator and the pressurizing piston in the sealed space, an outer sleeve that slidably holds an outer periphery of the pressurizing piston, and another spring that biases the outer sleeve toward the rear end face. One end of the another spring is engaged with a step formed on an inner periphery of the valve housing and the other end of the another spring is engaged with an axial rear end face of the outer sleeve.

With such the structure, a load of the spring biasing the outer sleeve is constant. Therefore, load management of the spring is easy.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENTS

Figure 1:
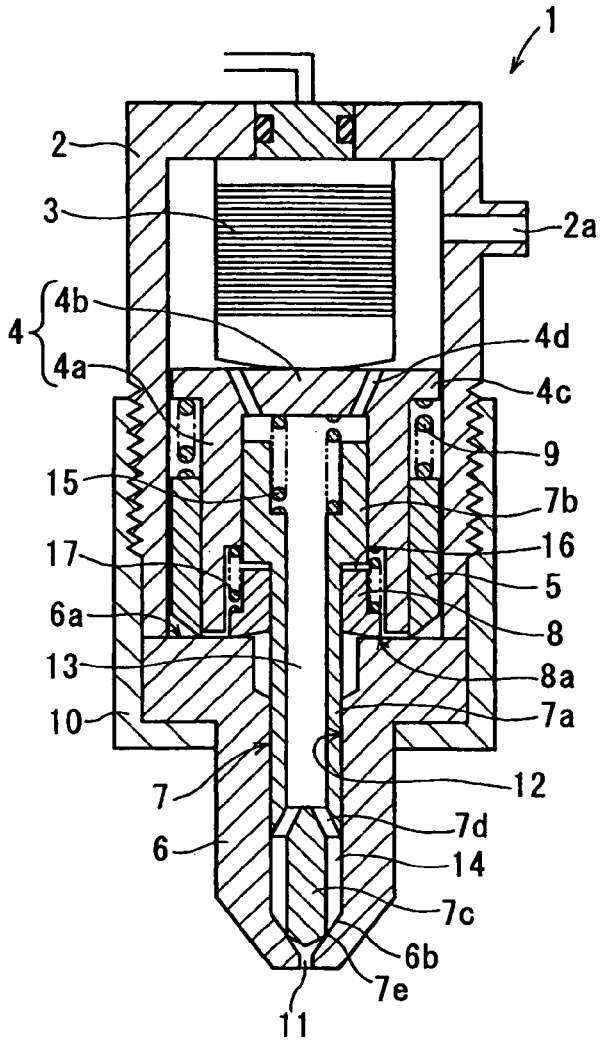
FIG. 1 is a sectional view showing an injector according to a first embodiment of the present invention.

Referring to FIG. 1, an injector 1 according to a first embodiment of the present invention is illustrated. The injector 1 of the present embodiment is a device that is attached to each cylinder of a diesel engine and that injects high pressure fuel, which is supplied from a common rail (not shown), directly into a combustion chamber in the cylinder, for example. As shown in FIG. 1, the injector 1 includes a valve housing 2, a piezoelectric actuator 3, a pressurizing piston 4, an outer sleeve 5, a valve body 6, a needle 7, an inner sleeve 8 and the like.

The valve housing 2 defines a sealed space between the valve housing 2 and the valve body 6 and is formed with a fuel inlet 2*a* connected to the common rail through a fuel pipe (not shown). The sealed space is filled with high pressure fuel flowing in from the fuel inlet 2*a*.

The piezoelectric actuator 3 is a common actuator having a capacitor structure of alternately laminated piezoelectric ceramic layers such as PZT (lead zirconate titanate) and electrode layers, for example. If voltage is applied, the piezoelectric actuator 3 elongates in the lamination direction. The piezoelectric actuator 3 is arranged inside the sealed space of the valve housing 2. An end (upper end in FIG. 1) of the piezoelectric actuator 3 in the lamination direction is fixed to the valve housing 2.

The pressurizing piston 4 is arranged on the other end side of the piezoelectric actuator 3 in the sealed space of the valve housing 2 and moves in an axial direction (vertical direction in the drawing) in response to displacement of the piezoelectric actuator 3. The pressurizing piston 4 consists of a cylindrical wall section 4*a* and a head section 4*b* that blocks one end side (upper side in the drawing) of the cylindrical wall section 4*a*. The pressurizing piston 4 is in contact with the piezoelectric actuator 3 in a state where the head section 4*b* is pressed against the other end side of the piezoelectric actuator 3 by a reaction force of a spring 9 located between a flange section 4*c* provided on an outer periphery of the head section 4*b* and the outer sleeve 5. The head section 4*b* is formed with a communication hole 4*d* for connecting an inside and an outside of the pressurizing piston 4.

The outer sleeve 5 is formed in the shape of a cylindrical body slidably fitted to an outer periphery of the pressurizing piston 4 in the sealed space of the valve housing 2. An axial tip edge section 5*a* of the outer sleeve 5 is pressed against a rear end face 6*a* of the valve body 6 by the reaction force of the spring 9 (refer to FIG. 2). The axial tip end portion of the outer sleeve 5 is formed in the tapered shape with an external diameter gradually reducing toward the tip edge section 5*a*. The tip edge section 5*a* is formed at the minimum diameter portion of the tapered shape.

The valve body 6 is located in contact with an opening end of the valve housing 2 and is fixed to the valve housing 2 through a retaining nut 10. An injection hole 11 for injecting the fuel and a guide hole 12 for holding the needle 7 are formed in the valve body 6.

The injection hole 11 is formed in a tip end portion (lower end portion in the drawing) of the valve body 6 protruding into the combustion chamber of the diesel engine. The guide hole 12 is bored from the rear end face 6*a* of the valve body 6 toward the tip end portion of the valve body 6. A seat face 6*b* in a conical shape is formed at a tip end portion of the guide hole 12. A rear end side portion of the guide hole 12 (on a side opposite from the seat face 6*b*) has an internal diameter larger than that of the portion holding the needle 7.

The needle 7 has a middle shaft section 7*a* slidably held at the guide hole 12 of the valve body 6, a large diameter section 7*b* provided on one end side of the middle shaft section 7*a*, and a small diameter shaft section 7*c* provided on the other end side of the middle shaft section 7*a* as a single body. The portion from the large diameter section 7*b* to the middle shaft section 7*a* is formed to be hollow, and the inside of the hollow portion is used as a fuel passage 13.

The large diameter section 7*b* has a larger external diameter than the middle shaft section 7*a* and is held slidably at an inner periphery of the pressurizing piston 4. The small diameter shaft portion 7*c* has an external diameter smaller than that of the middle shaft section 7*a*. A fuel sump 14 is formed between the outer periphery of the small diameter shaft section 7*c* and the inner periphery of the guide hole 12. A communication hole 7*d* connecting the above-mentioned fuel passage 13 and the fuel sump 14 is formed in the stepped section between the middle shaft section 7*a* and the small diameter shaft section 7*c*. A seat section 7*e* is provided in the tip end portion of the small diameter shaft section 7*c* and is seated on the seat face 6*b* of the valve body 6 at the time of the valve-closing of the needle 7.

Figure 2:
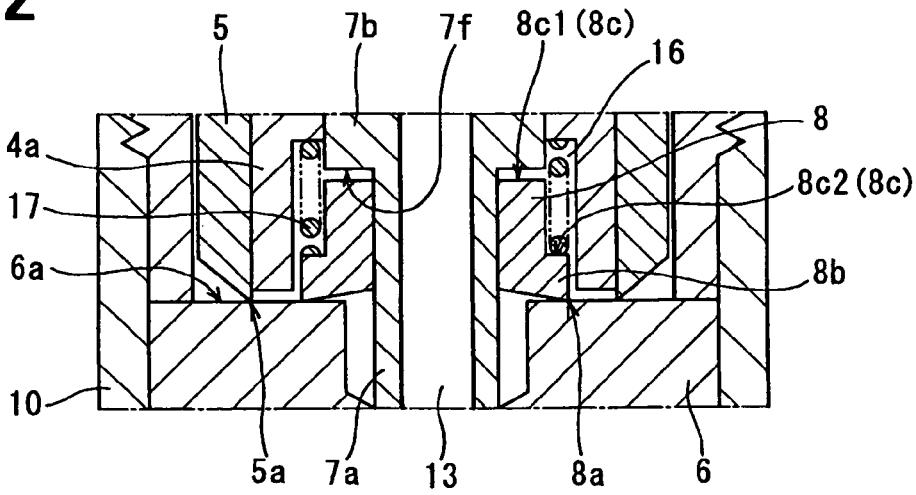
FIG. 2 is a sectional view showing a substantial portion of the injector according to the first embodiment.

In the needle 7, a spring 15 is located between a step formed on the inner periphery of the large diameter section 7*b* and the head section 4*b* of the pressurizing piston 4. A reaction force of the spring 15 functions as a valve closing force for biasing the needle 7 in a valve closing direction (downward direction in the drawing). As shown in FIG. 2, internal pressure of a pressure chamber 16 (mentioned later) filled with the high pressure fuel acts on a stepped face (referred to as a needle pressure receiving face 7*f*) formed between the large diameter section 7*b* and the middle shaft section 7*a* to function as a valve opening force for biasing the needle 7 in a valve opening direction (upward direction in the drawing).

Next, the inner sleeve 8 and the pressure chamber 16 will be explained with reference to FIG. 2. The inner sleeve 8 is formed in the shape of a cylindrical body slidably fitted to the outer periphery of the middle shaft section 7*a* of the needle 7 protruding from the rear end face 6*a* of the valve body 6 in a direction opposite to the injection hole side (upward in the drawing). The inner sleeve 8 receives a reaction force of a spring 17 held between the inner sleeve 8 and the pressurizing piston 4, so an edge section 8*a* provided at an axial tip end portion of the inner sleeve 8 is closely pressed against the rear end face 6*a* of the valve body 6. The edge section 8*a* is provided by an outermost diameter portion of the inner sleeve 8. The edge section 8*a* is in a close contact with the rear end face 6*a* of the valve body 6 at the entire circumference thereof. Thus, the pressure chamber 16 is defined by the valve body 6, the pressurizing piston 4 and the needle 7 between the inner sleeve 8 and the outer sleeve 5. The pressure chamber 16 is filled with the high pressure fuel.

An inner periphery sliding face of the inner sleeve 8 fitted with the outer periphery of the middle shaft section 7*a* inhibits the high pressure fuel of the pressure chamber 16 from flowing out toward the injection hole side through a sliding gap between the inner periphery sliding face and the outer peripheral face of the middle shaft section 7*a*. That is, the sliding gap provided between the inner periphery sliding face of the inner sleeve 8 and the outer peripheral face of the middle shaft section 7*a* is set small in a range not affecting the opening/closing action of the needle 7.

One end of the spring 17 is engaged with a step formed on the inner periphery of the cylindrical wall section 4*a* of the pressurizing piston 4, and the other end of the spring 17 is engaged with a spring receiving section 8*b* provided in the inner sleeve 8. The spring receiving section 8*b* is formed by enlarging the outer periphery of the inner sleeve 8 radially outward into the shape of a flange.

The inner sleeve 8 has a sleeve pressure receiving face 8*c*, to which the internal pressure of the pressure chamber 16 acts in a direction for biasing the inner sleeve 8 toward the valve body 6 side. The area of the sleeve pressure receiving face 8*c* is formed to be approximately 1.5 times as large as the area of the needle pressure receiving face 7*f*, for example. The sleeve pressure receiving face 8*c* includes a rear end face 8*c*1 of the inner sleeve 8 facing the needle pressure receiving face 7*f* and a seat face 8*c*2 of the spring receiving section 8*b* receiving the other end of the spring 17 as shown in FIG. 2.

Next, an operation of the injector 1 according to the present embodiment will be explained. If the voltage is applied to the piezoelectric actuator 3, the piezoelectric actuator 3 causes a displacement (i.e., extends) and the pressurizing piston 4 is pushed downward (in the drawing) due to the displacement. Accordingly, the volume of the pressure chamber 16 decreases and the internal pressure rises. Thus, if the hydraulic pressure (valve opening force) acting on the needle pressure receiving face 7*f* exceeds the valve closing force, the needle 7 lifts and provides the communication between the fuel sump 14 and the injection hole 11. Accordingly, the high pressure fuel supplied through the fuel sump 14 is injected from the injection hole 11 to the combustion chamber of the diesel engine.

Then, if the energization to the piezoelectric actuator 3 is stopped and the displacement is ceased (i.e., contraction occurs), the pressurizing piston 4 is pushed back by the reaction force of the spring 9. Thus, the volume of the pressure chamber 16 increases, so the internal pressure of the pressure chamber 16 is decreased. Thus, if the hydraulic pressure (valve opening force) acting on the needle pressure receiving face 7*f* decreases and becomes smaller than the valve closing force, the needle 7 is depressed by the reaction force of the spring 15, so the seat section 7*e* of the needle 7 is seated on the seat face 6*b* of the valve body 6 and the communication between the fuel sump 14 and the injection hole 11 is broken. Thus, the injection ends.

When the pressurizing piston 4 moves downward in the drawing and the volume of the pressure chamber 16 decreases, part of the high pressure fuel filled in the pressure chamber 16 leaks to an exterior of the pressure chamber 16 through the sliding gap between the outer sleeve 5 and the pressurizing piston 4, the sliding gap between the pressurizing piston 4 and the needle large diameter section 7*b*, the sliding gap between the inner sleeve 8 and the needle middle shaft section 7*a*, and the like. Then, when the energization to the piezoelectric actuator 3 is stopped and the pressurizing piston 4 moves upward, a gap arises between the tip edge section 5*a* of the outer sleeve 5 and the rear end face 6*a* of the valve body 6, and the pressure chamber 16 is replenished with the high pressure fuel. That is, if the pressurizing piston 4 moves upward, the reaction force of the spring 9 biasing the outer sleeve 5 toward the valve body 6 side decreases. Therefore, the outer sleeve 5 is pushed upward because the force (fuel pressure acting on the tip tapered surface of the outer sleeve 5) pushing up the outer sleeve 5 overcomes the reaction force of the spring 9. As a result, a gap arises between the tip edge section 5*a* of the outer sleeve 5 and the rear end face 6*a* of the valve body 6, and the pressure chamber 16 is replenished with the high pressure fuel filling the sealed space.

The injector 1 of the present embodiment has the inner sleeve 8 between the needle pressure receiving face 7*f* and the rear end face 6*a* of the valve body 6. Accordingly, as compared with the conventional injector (refer to Patent document 1), the volume of the pressure chamber 16 can be made compact. As a result, the valve opening force (the internal pressure of the pressure chamber 16 acting on the needle pressure receiving face 7*f*) necessary for lifting the needle 7 can be acquired efficiently. That is, the internal pressure of the pressure chamber 16 of the injector 1 of the present embodiment is higher than that of the conventional injector that does not have the inner sleeve 8 even if the moving distance of the pressurizing piston 4 driven by the piezoelectric actuator 3 is the same as that of the conventional injector. Therefore, the valve opening force applied to the needle 7 can be increased. As a result, by increasing the lift amount of the needle 7, injection of a larger flow rate can be performed, and also, the lifting of the needle 7 can be performed quickly. Thus, the injector 1 achieving high response and high performance can be provided. In other words, if the valve opening force necessary for lifting the needle 7 is the same as that of the conventional injector, the present embodiment exerts an effect of reducing the driving energy of the piezoelectric actuator 3.

Since the inner sleeve 8 is slidably fitted to the outer periphery of the middle shaft section 7*a* of the needle 7, the sliding sections of the inner sleeve 8 and the middle shaft section 7*a* can inhibit the fuel leak of the pressure chamber 16. That is, the high pressure fuel of the pressure chamber 16 is inhibited from flowing out toward the injection hole side through the sliding gap between the inner periphery sliding face of the inner sleeve 8 and the outer peripheral face of the middle shaft section 7*a*.

Furthermore, the edge section 8*a* provided on the entire circumference of the inner sleeve 8 is closely pressed against the rear end face 6*a* of the valve body 6. Accordingly, no gap is made between the edge section 8*a* and the rear end face 6*a*, so the high pressure fuel of the pressure chamber 16 can be inhibited from flowing out toward the injection hole side through a clearance between the edge section 8*a* and the rear end face 6*a*.

The inner sleeve 8 of the present embodiment is not fixed to the valve body 6 but is merely biased by the spring 17 toward the valve body 6 side. Therefore, the sleeve 8 can move in the radial direction with respect to the valve body 6. Therefore, precise processing is required only in the internal diameter (i.e., inner periphery sliding face) of the cylindrical body to be fitted with the middle shaft section 7*a* of the needle 7. It is not necessary to secure coaxiality of the inner sleeve 8 with the guide hole 12 formed in the valve body 6. The guide hole 12 of the valve body 6 holding the needle 7 is not required to inhibit the fuel leak between the guide hole 12 and the needle 7. Therefore, the management of the clearance between the guide hole 12 and the needle 7 can be made easier correspondingly. As a result, productivity can be improved.

The edge section 8*a* is formed in the axial end portion of the inner sleeve 8 on the valve body 6 side, and the edge section 8*a* is pressed against the rear end face 6*a* of the valve body 6. In this case, the contact pressure between the rear end face 6*a* of the valve body 6 and the edge section 8*a* becomes high. Therefore, sealing performance improves and the fuel leak from the pressure chamber 16 can be inhibited. Since the edge section 8*a* is formed in the outermost diameter portion of the inner sleeve 8, the internal pressure of the pressure chamber 16 is not applied to the end face of the inner sleeve 8 radially inside the edge section 8*a*. Since the internal pressure of the pressure chamber 16 does not function as the force pushing up the inner sleeve 8, suitable sealing performance can be secured.

The one end of the spring 17 biasing the inner sleeve 8 toward the valve body 6 side is engaged with the step provided on the inner periphery of the cylindrical wall section 4*a* of the pressurizing piston 4. Therefore, when the pressurizing piston 4 is driven by the piezoelectric actuator 3 and moves downward in FIG. 1 (i.e., when the internal pressure of the pressure chamber 16 increases), the biasing force of the spring 17 applied to the inner sleeve 8 increases. As a result, the edge section 8*a* of the inner sleeve 8 is strongly pressed against the rear end face 6*a* of the valve body 6. Therefore, the sealing performance improves and the effect of inhibiting the fuel leakage from the pressure chamber 16 improves.

The inner sleeve 8 has the sleeve pressure receiving face 8*c* (8*c*1, 8*c*2), to which the internal pressure of the pressure chamber 16 acts in the direction for biasing the inner sleeve 8 toward the valve body 6 side. The area of the sleeve pressure receiving face 8*c* is formed larger than the area of the needle pressure receiving face 7*f*. Accordingly, the force of the internal pressure of the pressure chamber 16 acting on the sleeve pressure receiving face 8*c* for depressing the inner sleeve 8 becomes greater than the force of the internal pressure of the pressure chamber 16 acting on the needle pressure receiving face 7*f* for pushing up the needle 7. Therefore, when the needle 7 lifts, the inner sleeve 8 can be prevented from lifting together with the needle 7.

Figure 3:
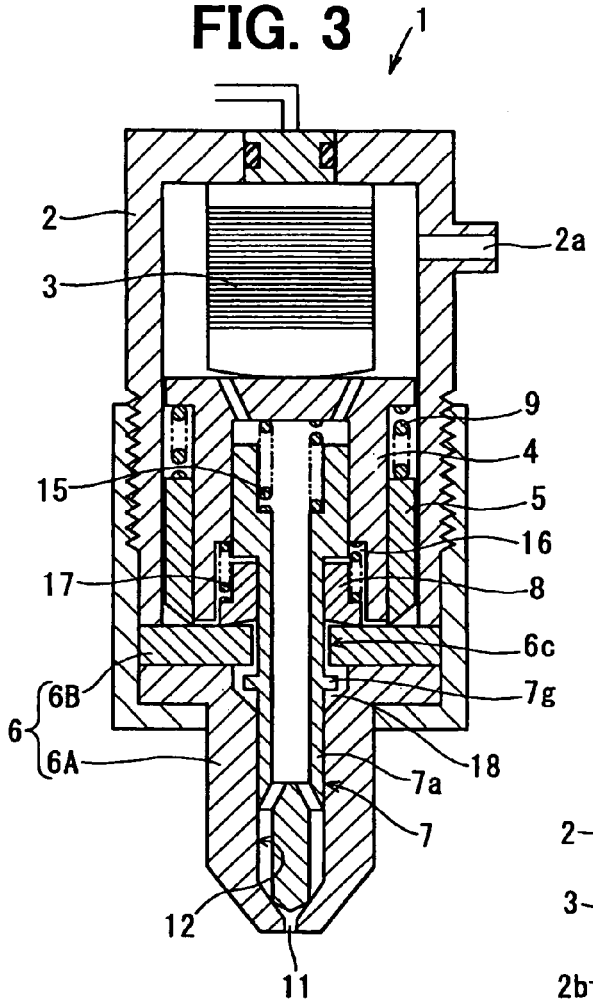
FIG. 3 is a sectional view showing an injector according to a third embodiment of the present invention.

Next, an injector 1 according to a second embodiment of the present invention will be described with reference to FIG. 3. FIG. 3 is a sectional view showing the injector 1 according to the present embodiment. The injector 1 of the present embodiment is an example having a stopper structure for limiting the lift amount of the needle 7 in addition to the structure of the first embodiment. As shown in FIG. 3, the valve body 6 consists of a body main member 6A and a spacing member 6B. The body main member 6A is formed with a guide hole 12. The spacing member 6B is arranged on a side of the body main member 6A opposite from the injection hole 11 (on an upper side in the drawing) and is formed with a loose insertion hole 6*c* in the radial center thereof. The needle 7 is loosely inserted into the loose insertion hole 6*c*.

An enlarged chamber 18 is formed in the guide hole 12 of the body main member 6A on a side opposite from the injection hole 11. The enlarged chamber 18 has an internal diameter larger than that of the loose insertion hole 6*c*.

An end face of the spacing member 6B defining a side of the enlarged chamber 18 opposite from the injection hole 11 and radially inside the inner periphery of the enlarged chamber 18 functions as a stopper face for limiting the lift amount of the needle 7.

The needle 7 has a flange section 7*g* projecting radially outward from the outer periphery of the middle shaft section 7*a* passing through the inside of the enlarged chamber 18. An external diameter of the flange section 7*g* is formed larger than the internal diameter of the loose insertion hole 6*c*.

With such the structure, if the needle 7 lifts by a predetermined amount, the flange section 7*g* provided to the middle shaft section 7*a* contacts the stopper face of the spacing member 6B. Thus, the lift amount of the needle 7 is limited. Accordingly, irrespective of the displacement variation of the piezoelectric actuator 3, the stable injection quantity can be obtained and metering accuracy of the injection quantity improves. Thus, the injector 1 with high performance can be provided.

Figure 4:
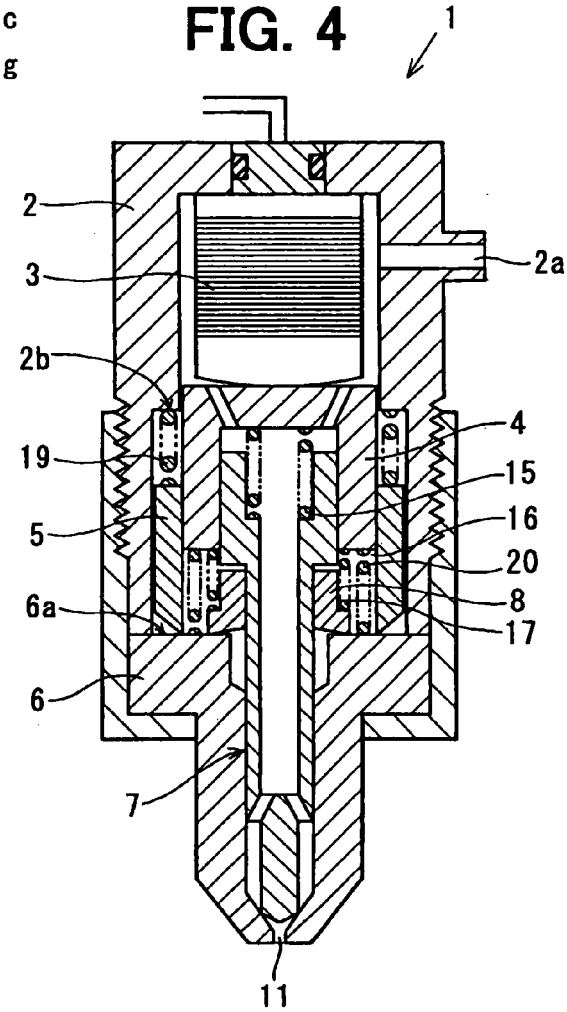
FIG. 4 is a sectional view showing an injector according to a third embodiment of the present invention.

Next, an injector 1 according to a third embodiment of the present invention will be described with reference to FIG. 4. FIG. 4 is a sectional view showing the injector 1 according to the present embodiment. The injector 1 of the present embodiment is an example providing a spring 19 for biasing the outer sleeve 5 toward the valve body 6 side and providing an engagement face for the spring 19 to the valve housing 2 as shown in FIG. 4. That is, one end of the spring 19 is engaged with a step 2*b* formed on the inner periphery of the valve housing 2, and the other end of the spring 19 is engaged with an axial rear end face of the outer sleeve 5.

A spring 20 for pushing back the pressurizing piston 4 when the energization to the piezoelectric actuator 3 is stopped is located between the pressurizing piston 4 and the rear end face 6*a* of the valve body 6.

In the injector 1 according to the first embodiment, the spring 9 (refer to FIG. 1) is located between the flange section 4*c* of the pressurizing piston 4 and the outer sleeve 5. Therefore, the load of the spring 9 changes according to the movement of the pressurizing piston 4. As contrasted thereto, in the structure according to the present embodiment, the load of the spring 19 biasing the outer sleeve 5 is constant regardless of the movement of the pressurizing piston 4. Therefore, load management of the spring 19 is easy.

The spring 20 is required to exert the reaction force only for pushing back the pressurizing piston 4 when the energization to the piezoelectric actuator 3 is stopped. Accordingly, as compared with the spring 9 of the first embodiment, a set load (initial load as of assembly) can be reduced. As a result, the loading of the piezoelectric actuator 3 can be reduced, thereby contributing to the improvement of the efficiency.

Figure 5:
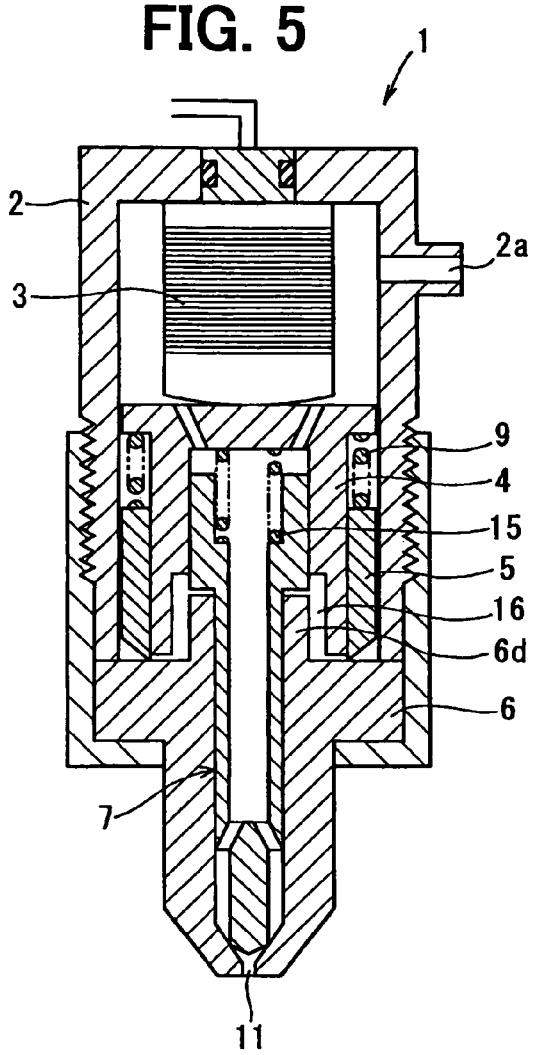
FIG. 5 is a sectional view showing an injector of a modified example of the present invention.
Figure 6:
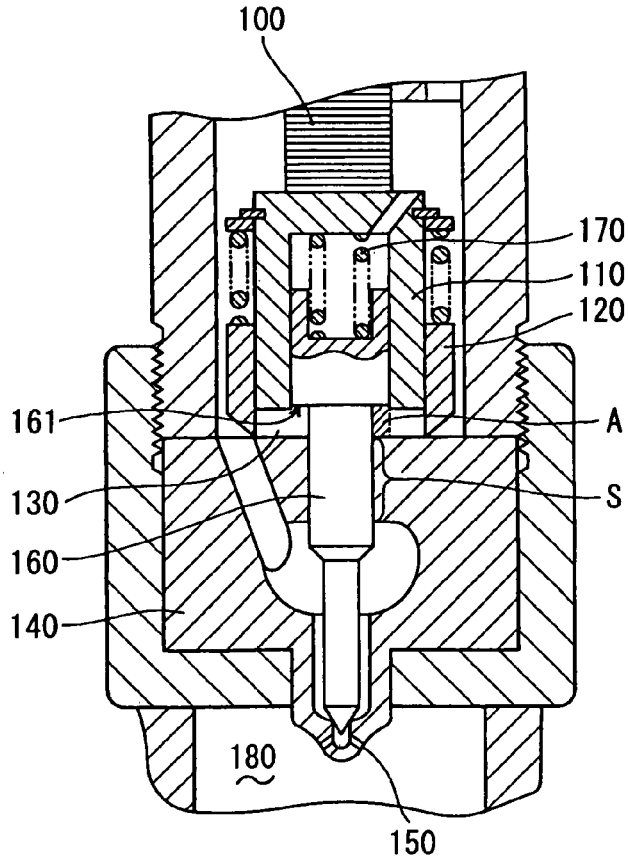
FIG. 6 RELATED ART
FIG. 6 is a sectional view showing an injector of a related art.

The injector 1 according to each of the first to third embodiments uses the inner sleeve 8 provided as a body separate from the valve body 6 to reduce the volume of the pressure chamber 16. Alternatively, for example, as shown in FIG. 5, a protruding section 6*d* may be formed integrally with the valve body 6 instead of the inner sleeve 8. Thus, the volume of the pressure chamber 16 can be made compact like the injector 1 according to each of the first to third embodiments.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An injector comprising:

a piezoelectric actuator that causes displacement when voltage is applied thereto;

a pressurizing piston that is driven by the piezoelectric actuator to move in an axial direction;

a pressure chamber that stores a pressurization fluid inside such that pressure of the pressurization fluid changes according to the movement of the pressurizing piston;

a valve body that is formed with a guide hole in the axial direction and with an injection hole at a tip end portion of the guide hole, the valve body being structured such that an axial rear end face thereof on a side opposite from the injection hole side defines a wall face defining the pressure chamber;

a needle that is slidably held in the guide hole and that opens and closes the injection hole, the needle having a middle shaft section protruding from the rear end face in a direction opposite from the injection hole side and a needle pressure receiving face, which has an external diameter larger than that of the middle shaft section and receives internal pressure of the pressure chamber in the axial direction such that the internal pressure of the pressure chamber acting on the needle pressure receiving face functions as a valve opening force for biasing the needle in a valve opening direction;

an inner sleeve that is located inside the pressure chamber and that is formed in the shape of a cylindrical body slidably fitted with an outer periphery of the middle shaft section; and a spring that biases the inner sleeve toward the rear end face, wherein the inner sleeve has an inner periphery sliding face of the cylindrical body for inhibiting the pressurization fluid in the pressure chamber from flowing out toward the injection hole side through a sliding gap between an outer peripheral face of the middle shaft section and the inner sleeve and an axial end portion for inhibiting the pressurization fluid in the pressure chamber from flowing out toward the injection hole side through a portion of the inner sleeve closely pressed against the rear end face by the spring.

2. The injector as in claim 1, wherein the inner sleeve has an edge section in an entire circumference of the axial end portion thereof and the edge section is pressed against the rear end face.

3. The injector as in claim 2, wherein the edge section of the inner sleeve is formed at an outermost periphery of the axial end portion of the inner sleeve.

4. The injector as in claim 1, wherein the inner sleeve has a spring receiving section formed in a flange shape by enlarging an outer peripheral portion of the cylindrical body radially outward, and one end of the spring is engaged with the pressurizing piston and the other end of the spring is engaged with the spring receiving section.

5. The injector as in claim 1, wherein the inner sleeve has a sleeve pressure receiving face, to which the internal pressure of the pressure chamber acts in a direction for biasing the inner sleeve toward the valve body side, the sleeve pressure receiving face having a larger area than that of the needle pressure receiving face.

6. The injector as in claim 1, wherein the valve body includes a body main member formed with the guide hole and a spacing member that is located on a side of the body main member opposite from the injection hole side and that is formed with a loose insertion hole in a radial center thereof for loosely inserting the needle therein, the body main member has an enlarged chamber having an internal diameter larger than that of the loose insertion hole on a side opposite from the injection hole side, an end face of the spacing member defining a side of the enlarged chamber opposite from the injection hole side and radially inside an inner periphery of the enlarged chamber functions as a stopper face for limiting a lift amount of the needle, the needle has a flange section projecting radially outward from an outer periphery of a portion of the needle passing through the inner periphery of the enlarged chamber, the flange section having an external diameter larger than the internal diameter of the loose insertion hole, and the lift amount of the needle is limited as the flange section contacts the stopper face when the needle lifts by a predetermined amount in the valve opening direction.

7. The injector as in claim 1, further comprising:

a valve housing that defines a sealed space filled with the high pressure fluid between the valve body and the valve housing and that accommodates at least the piezoelectric actuator and the pressurizing piston in the sealed space;

an outer sleeve that slidably holds an outer periphery of the pressurizing piston; and another spring that biases the outer sleeve toward the rear end face, wherein one end of the another spring is engaged with a step formed on an inner periphery of the valve housing and the other end of the another spring is engaged with an axial rear end face of the outer sleeve.

* * * * *